US006194887B1

(12) United States Patent
Tsukada

(10) Patent No.: US 6,194,887 B1
(45) Date of Patent: Feb. 27, 2001

(54) INTERNAL VOLTAGE GENERATOR

(75) Inventor: Shyuichi Tsukada, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/434,117

(22) Filed: Nov. 5, 1999

(30) Foreign Application Priority Data

Nov. 6, 1998 (JP) ..... 10-316325

(51) Int. Cl.[7] ..... G05F 3/16; G05F 3/04

(52) U.S. Cl. ..... 323/315; 323/312; 323/313; 327/535

(58) Field of Search ..... 323/315, 313, 323/312, 314; 307/296.4, 296.6, 296.8; 327/541, 534, 537, 535

(56) References Cited

U.S. PATENT DOCUMENTS 5,352,935 * 10/1994 Yamamura et al. ..... 307/296.4

FOREIGN PATENT DOCUMENTS 5-127764 5/1993 (JP) .
6-19565 * 1/1994 (JP) .
7-30334 1/1995 (JP) .
11-15541 1/1999 (JP) .

* cited by examiner

*Primary Examiner*—Peter S. Wong
*Assistant Examiner*—Rajnikant B. Patel
(74) *Attorney, Agent, or Firm*—Young & Thompson

(57) ABSTRACT

An internal voltage generator for supplying a lowered voltage to an internal circuit of a semiconductor integrated circuit includes an output transistor formed from an N-channel, a reference voltage generator for outputting a reference voltage, and a differential amplifier having a non-inverted input terminal to which the reference voltage is inputted and an inverted input terminal to which the lowered voltage is fed back for outputting a control voltage to the gate of the output transistor so that the reference voltage and the lowered voltage may be equal to each other. By the construction of the internal voltage generator, the capacitance of a phase compensating capacitor for preventing oscillation of a feedback loop formed from the output transistor and the differential amplifier can be reduced, and an increase of the layout area of devices is prevented.

13 Claims, 13 Drawing Sheets

INTERNAL VOLTAGE GENERATOR

BACKGROUND OF THE INVENTION

1. Field of the Invention

This invention relates to an internal voltage generator which supplies a predetermined voltage different from an external power supply voltage externally supplied thereto to an internal circuit of a semiconductor integrated circuit.

2. Description of the Related Art

A semiconductor integrated circuit device such as a semiconductor memory device in recent years does not use external power supply voltage $V_{CC}$ externally supplied thereto as it is, but lowers or raises it to produce a predetermined internal power supply voltage and supplies it to an internal circuit, by which the voltage is required, to achieve reduction of the power consumption and augmentation of the reliability of a device.

In a semiconductor memory device, for example, the sizes of transistors and other elements are reduced in order to increase the storage capacity or raise the access speed. However, since such reduction of the sizes of transistors and other elements makes it impossible to apply a high voltage to the transistors, a lowered voltage power supply circuit is provided in the semiconductor memory device to apply a lowered voltage lower than the external power supply voltage to the transistors.

Meanwhile, to word lines of a semiconductor memory device such as a DRAM (Dynamic RAM) or a non-volatile memory, a raised voltage must be applied which is higher than an external power supply voltage externally supplied thereto in order to secure a desired performance. Further, in a DRAM or some other device, a semiconductor substrate is sometimes biased to a negative voltage in order to secure a high charge holding characteristic. In this manner, a semiconductor memory device is required to include therein an internal voltage generator which generates various internal power supply voltages.

A conventional lowered voltage power supply circuit shown in FIG. 1 includes output transistor 101 formed from a P-channel MOSFET (Metal Oxide Semiconductor Field Effect Transistor) for supplying a lowered voltage to an internal circuit which serves as a load, differential amplifier 102 for outputting a control voltage to control the gate voltage of output transistor 101, reference voltage generator 103 for supplying predetermined reference voltage $V_{REF}$ to differential amplifier 102, and phase compensating capacitor 104 interposed between an output contact of output transistor 101 and the ground potential for preventing oscillation. External power supply voltage $V_{CC}$ is supplied to output transistor 101 and differential amplifier 102.

Differential amplifier 102 includes transistors Q1, Q2 formed from P-channel MOSFETs having the gates connected commonly, transistors Q3, Q4 formed from N-channel MOSFETs connected in series to transistors Q1, Q2, respectively, and having the sources connected commonly, and current source 5 for supplying predetermined current to transistors Q1 to Q4. The gate and the drain of transistor Q2 are connected to each other so that transistors Q1, Q2 form a current mirror circuit and operate so as to make the current flowing between the gate and the drain of transistor Q1 and the current flowing between the gate and the drain of transistor Q2 equal to each other.

Reference voltage $V_{REF}$ is applied to the gate of transistor Q3, which serves as inverted input terminal 106 of differential amplifier 102, and the drain voltage of transistor Q3 which is as an output of differential amplifier 102 is applied to the gate of output transistor 101. Output voltage $V_{INT}$ (lowered voltage) output from the drain of output transistor 101 is fed back to the gate of transistor Q4 which serves as non-inverted input terminal 107 of differential amplifier 102.

In the lowered voltage power supply circuit having the construction described above, when output voltage $V_{INT}$ is lower than reference voltage $V_{REF}$, for example, the voltage at node B of differential amplifier 102 rises while the voltage at node A lowers. Consequently, source-gate voltage $V_{GS}$ of output transistor 101 rises, and the lowered voltage power supply circuit operates in a direction in which it raises output voltage $V_{INT}$. On the other hand, when output voltage $V_{INT}$ is higher than reference voltage $V_{REF}$, since the voltage at node B of differential amplifier 102 lowers and the voltage at node A rises, source-gate voltage $V_{GS}$ of output transistor 101 lowers, and the lowered voltage power supply circuit operates in the other direction in which it lowers output voltage $V_{INT}$. In other words, the lowered voltage power supply circuit shown in FIG. 1 controls so that output voltage $V_{INT}$ may become equal to reference voltage $V_{REF}$.

Reference voltage generator 103 of the lowered voltage power supply circuit shown in FIG. 1 will be described in detail below with reference to the drawings.

Referring to FIG. 2, the conventional reference voltage generator includes, similarly to the lowered voltage power supply circuit shown in FIG. 1, output transistor 111 formed from a P-channel MOSFET for supplying reference voltage $V_{REF}$ to a load, differential amplifier 112 for outputting a control voltage to control the gate voltage of output transistor 111, phase compensating capacitor 114 interposed between an output contact of output transistor 111 and the ground potential for preventing oscillation, and trimming resistors R101, R102 serving as a voltage divider for dividing reference voltage $V_{REF}$ output from output transistor 111 at a predetermined ratio. External power supply voltage $V_{CC}$ is supplied to output transistor 111 and differential amplifier 112.

To non-inverted input terminal 117 of differential amplifier 112, a voltage obtained by dividing the output voltage of output transistor 111 by trimming resistors R101, R102. Thereupon, reference voltage $V_{REF}$ which depends upon comparison voltage $V_R$ applied to inverted input terminal 116 and a resistance ratio of trimming resistors R101, R102 as given by expression (1) given below is outputted from output transistor 111:

$$V_{REF}=V_R\times(R101+R102)/R102 \quad (1)$$

Comparison voltage $V_R$ applied to inverted input terminal 116 of differential amplifier 112 shown in FIG. 2 is supplied from such a circuit as shown in-FIG. 3, for example.

Referring to FIG. 3, the generator of comparison voltage $V_R$ includes two transistors Q5, Q6 formed from N-channel MOSFETs having threshold voltages different from each other and outputs a difference voltage between threshold voltages $V_T$ of transistors Q5, Q6 as comparison voltage $V_R$.

In the generator of comparison voltage $V_R$ having the construction described, even if threshold voltages VT of transistors Q5, Q6 are varied by a variation of the ambient temperature, the variation of comparison voltage $V_R$ can be suppressed to a low value by selectively determining the sizes of transistors Q5, Q6 and the resistance values of resistors R103, R104 so that the voltage variations of threshold voltages $V_T$ offset each other.

If very small amplitude signal IN of a low frequency which corresponds to a disturbance is input to non-inverted input terminal 107 of differential amplifier 102 of the conventional lowered voltage power supply circuit shown in FIG. 1, then a signal having the same phase as input signal IN but having an amplified amplitude is output to node A which serves as an output of differential amplifier 102 as seen in FIG. 4. Here, however, it is assumed that lower output voltage $V_{INT}$ is disconnected from non-inverted input terminal 107 in order to facilitate understandings. At this time, signal $V_{INT}$ having a polarity opposite to that of input signal IN but having an amplitude further amplified than that at node A is output to the drain of output transistor 101. It is to be noted that the amplitude ratio between input signal IN and the signal appearing at node A is gain $G_{01}$ of differential amplifier 102, and the amplitude ratio between the signal appearing at node A and output signal $V_{INT}$ is gain $G_{02}$ of output transistor 101.

Then, if the frequency of input signal IN is raised, then the signal appearing at node A cannot follow up the frequency of input signal IN and the phase of the signal appearing at node A is delayed. Also the gain decreases, and the amplitude decreases when compared with that when input signal IN has the low frequency. Similarly, also output signal $V_{INT}$ exhibits a phase delayed further from that of the signal at node A, and the amplitude decreases when compared with that when input signal IN has the low frequency.

If the frequency of input signal IN is further raised, then the phase of output signal $V_{INT}$ is delayed further, and finally, the phase of output voltage $V_{INT}$ is delayed by 180 degrees and becomes the same phase as input signal IN. At this time, if the amplitude of output signal $V_{INT}$ is greater than that of input signal IN (if total gain $G_{01}+G_{02}$ of differential amplifier 102 and output transistor 101 is higher than 0 dB), then the lowered voltage power supply circuit shown in FIG. 1 oscillates. The relationship between the total gain and the phase with respect to a variation of the frequency is indicated by a Bode diagram shown in FIG. 6.

As seen from FIG. 6, when total gain $G_{01}+G_{02}$ of differential amplifier 102 and output transistor 101 is equal to 0 dB (gain=1 time), if phase $\phi$ (sum value of $\phi 1$ of differential amplifier 102 and $\phi 2$ of output transistor 101) of output signal $V_{INT}$ with respect to input signal IN is delayed with respect to −180 degrees, then the lowered voltage power supply circuit oscillates, but if it is advanced with respect to −180 degrees, then the lowered voltage power supply circuit does not oscillate. The difference between the phase when total gain $G_{01}+G_{02}$ is equal to 0 dB and −180 degrees is called phase margin $\Delta\phi$, and generally, as phase margin $\Delta\phi$ increases, the liability of oscillation of the circuit increases.

In order to increase phase margin $\Delta\phi$, the difference between cutoff frequency (frequency with which the gain decreases 3 dB) $\omega_{P1}$ of differential amplifier 102 and cutoff frequency $\omega_{P2}$ Of output transistor 101 should be increased. In the lowered voltage power supply circuit shown in FIG. 1, either cutoff frequency $\omega_{P2}$ of output transistor 101 should be lowered to lower the gain at a high frequency, or cutoff frequency $\omega_{P1}$ of differential amplifier 102 should be raised to increase the response speed.

Usually, to lower the cutoff frequency can be realized more simply than to raise the cutoff frequency. In the conventional lowered voltage power supply circuit, phase compensating capacitor 104 of a large capacity is provided on the output side to lower cutoff frequency $\omega_{P2}$ of output transistor 101 to increase phase margin $\Delta\phi$ to prevent oscillation of the circuit.

However, an increase of the capacitance of phase compensating capacitor 104 results in necessity for a greater area to lay out circuit elements. Therefore, it is difficult to adopt the construction described above for semiconductor integrated circuits in recent years for which the demand for higher integration is progressively increasing.

SUMMARY OF THE INVENTION

It is an object of the present invention to provide an internal voltage generator wherein the capacitance of a phase compensating capacitor is decreased to prevent an increase the layout area for devices.

In order to attain the object described above, according to the present invention, an internal voltage generator employs a construction which is similar to that of the conventional internal voltage generator but uses an N-channel MOSFET for the output transistor. Further, the internal voltage generator is constructed such that a raised voltage obtained by raising the external power supply voltage is supplied to the differential amplifier while a predetermined reference voltage is input to the non-inverted input terminal of the differential amplifier and the output voltage of the differential amplifier is fed back to the inverted input terminal of the differential amplifier.

In the internal voltage generator constructed in such a manner as described above, since an N-channel MOSFET is employed for the output transistor, the output transistor operates as a source follower and exhibits a gain equal to 1. Accordingly, the frequency with which the total gain becomes equal to 0 dB becomes lower than that of the conventional internal voltage generator. Consequently, even if the phase delay amount by the phase compensating capacitor is decreased, oscillation of the internal voltage generator can be prevented.

The above and other objects, features and advantages of the present invention will become apparent from the following description with reference to the accompanying drawings which illustrate examples of the present invention.

DETAILED DESCRIPTION OF THE PREFERRED EMBODIMENTS (First Embodiment)

A first embodiment of an internal voltage generator of the present invention will be described below taking a lowered voltage power supply circuit as an example.

As described hereinabove, in order to increase phase margin $\Delta\phi$, the conventional lowered voltage power supply circuit adopts the technique of providing a phase compensating capacitor of a high capacitance on the output side to lower cutoff frequency $\omega_{P2}$ of the output transistor to increase the difference between cutoff frequency $\omega_{P1}$ of the differential amplifier and cutoff frequency $\omega_{P2}$ of the output transistor. In the present embodiment, the gain of the output transistor is lowered to achieve a similar effect.

Figure 1:
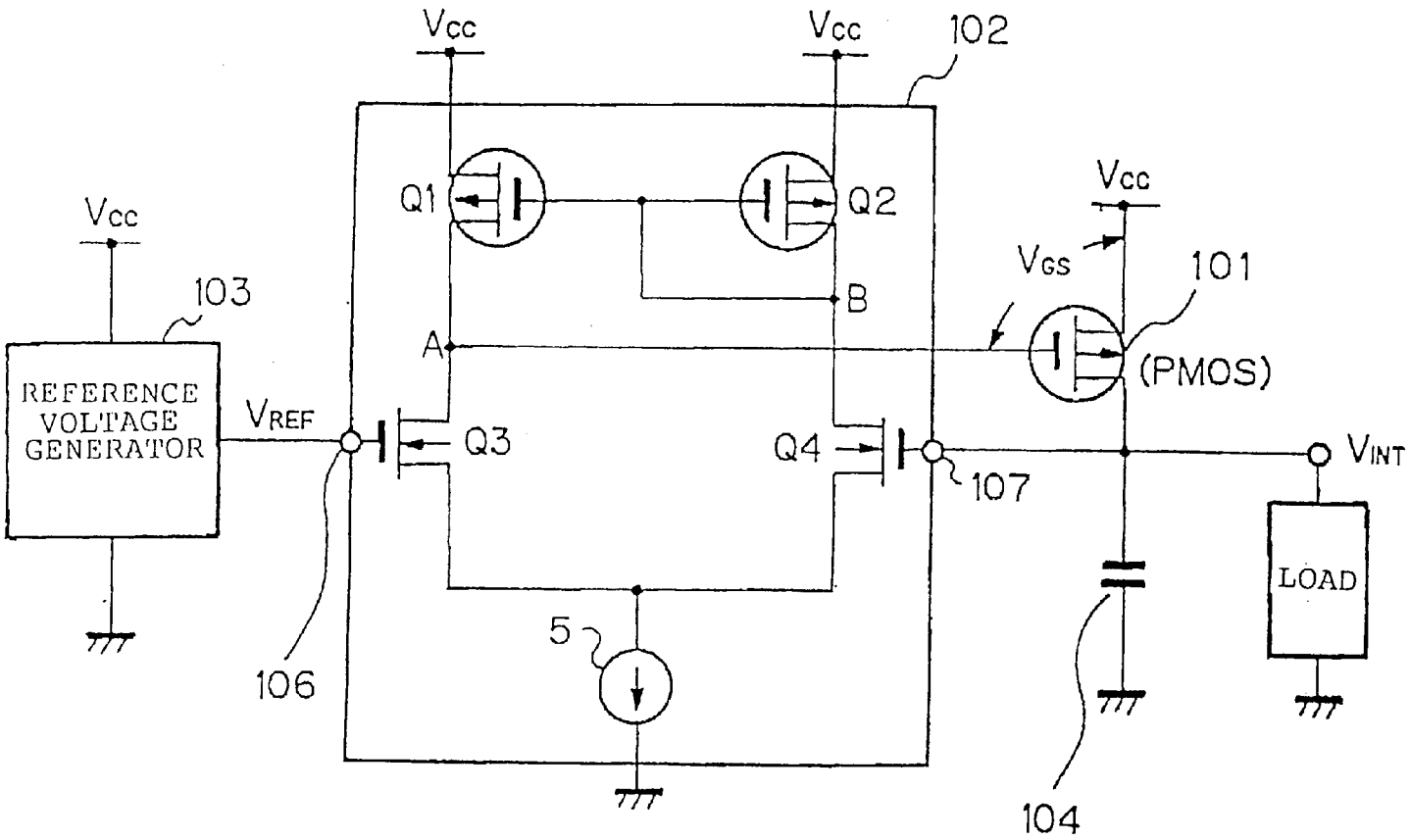
FIG. 1 (PRIOR ART)
FIG. 1 is a circuit diagram showing a construction of a lowered voltage power supply circuit which is an example of a conventional internal voltage generator.
Figure 7:
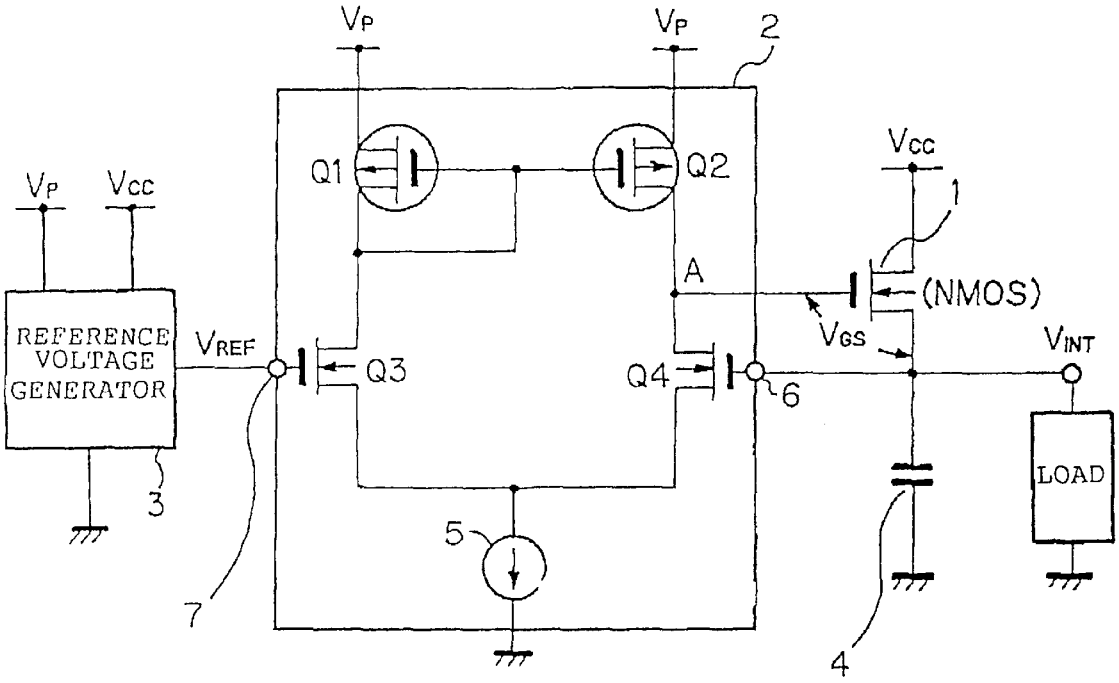
FIG. 7 is a circuit diagram showing an example of a construction of a lowered voltage power supply circuit according to a first embodiment of an internal voltage generator of the present invention.

As shown in FIG. 7, the lowered voltage power supply circuit of the first embodiment is a modification to the conventional lowered voltage power supply circuit shown in FIG. 1 wherein output transistor 1 is changed from a P-channel MOSFET to an N-channel MOSFET and raised voltage Vp obtained by raising external power supply voltage $V_{CC}$ is supplied to differential amplifier 2. Further, reference voltage $V_{REF}$ output from reference voltage generator 3 is input to non-inverted input terminal 7 of differential amplifier 2, and output voltage $V_{INT}$ is fed back to inverted input terminal 6 of differential amplifier 2. The construction of the remaining portion of the lowered voltage power supply circuit of the present embodiment is similar to that of the conventional lower voltage power supply circuit, and therefore, an overlapping description of it is omitted here.

In the lowered voltage power supply circuit having the construction described above, when output voltage $V_{INT}$ is lower than reference voltage $V_{REF}$, the potential at node A which is an output contact of differential amplifier 2 rises. Consequently, the lowered voltage power supply circuit operates in a direction in which source-gate voltage $V_{GS}$ of output transistor 1 rises and the potential of output voltage $V_{INT}$ rises. On the other hand, when output voltage $V_{INT}$ is higher than reference voltage $V_{REF}$, the potential at node A lowers. Consequently, source-gate voltage $V_{GS}$ of output transistor 1 lowers, and the lowered voltage power supply circuit operates in a direction in which the potential of output voltage $V_{INT}$ lowers. Accordingly, also the lowered voltage power supply circuit shown in FIG. 7 controls so that output voltage $V_{INT}$ may become equal to reference voltage $V_{REF}$ similarly to the conventional lowered voltage power supply circuit.

Since output transistor 1 in the form of an N-channel MOSFET operates as a source follower, output voltage $V_{INT}$ is limited to a value lower by threshold voltage $V_T$ of output transistor 1 than the voltage at node A which is an output of differential amplifier 2. If the voltage at node A varies 0.1 V, for example, also output voltage $V_{INT}$ varies approximately 0.1 V. In other words, the gain of output transistor 1 of the lowered voltage power supply circuit of the present embodiment is 1 (0 dB), and the gain is significantly lower when compared with that of the conventional lowered voltage power supply circuit which employs a P-channel MOSFET for the output transistor.

Figure 8:
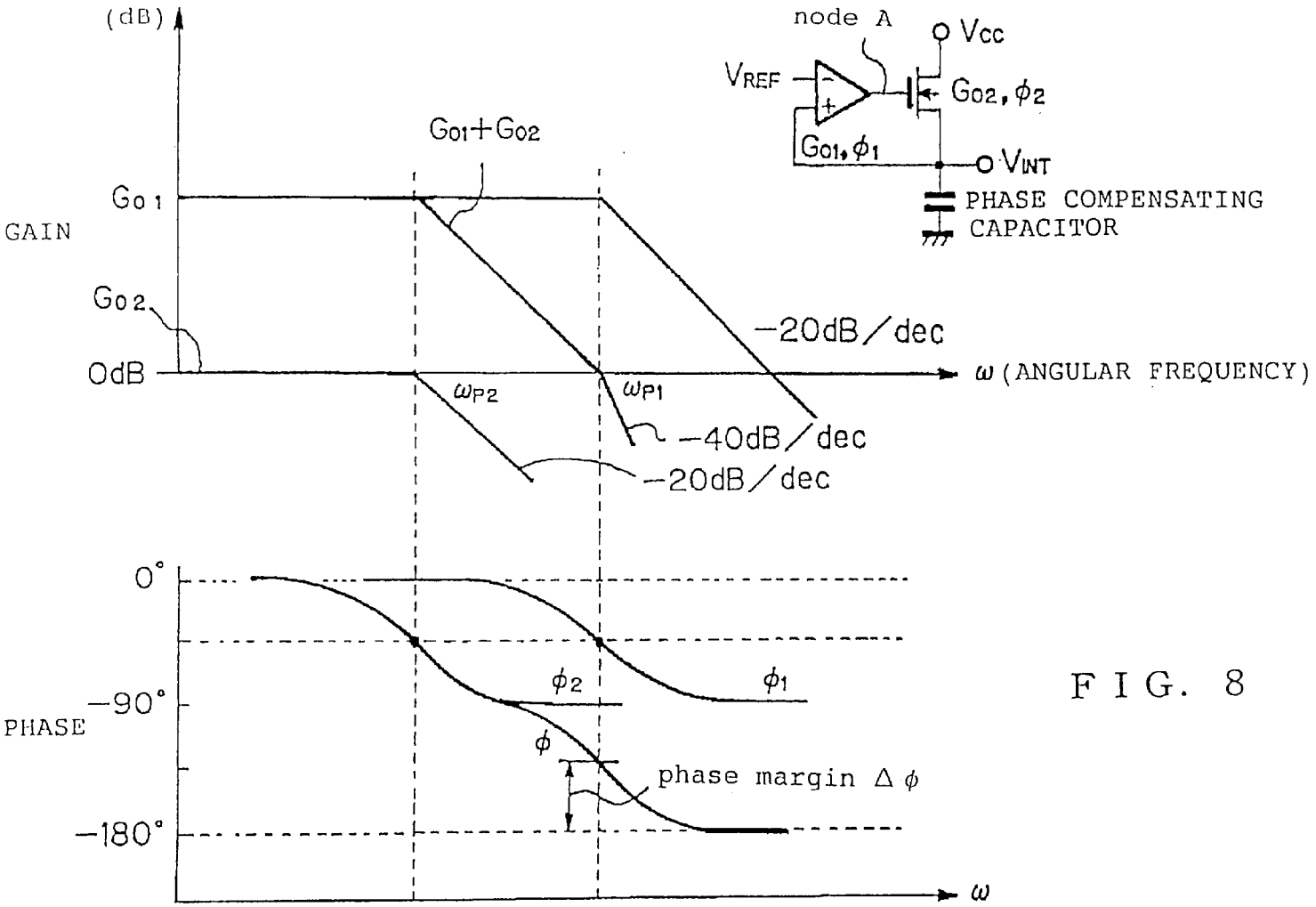
FIG. 8 is a Bode diagram showing a frequency characteristic when a phase compensating capacitor of the lowered voltage power supply circuit shown in FIG. 7 has a capacitance similar to that in the conventional lowered voltage power supply circuit.

As seen from a Bode diagram of FIG. 8, total gain $G_{01}+G_{02}$ of differential amplifier 2 (gain $G_{01}$) and output transistor 1 (gain $G_{02}$) of the lowered voltage power supply circuit of the present embodiment is equal to gain $G_{01}$ of differential amplifier 2, and the cutoff frequency of the lowered voltage power supply circuit is equal to cutoff frequency $\omega_{P2}$ Of output transistor 1.

At this time, the frequency characteristic of total phase $\phi$ of phase $\phi 1$ of differential amplifier 2 and phase $\phi 2$ of output transistor 1 is similar to that of the conventional lowered voltage power supply circuit. However, the frequency with which total gain $G_{01}+G_{02}$ is equal to 0 dB is lower than that of the conventional lowered voltage power supply circuit. Accordingly, if the capacitance of phase compensating capacitor 4 is equal to that of the conventional lowered voltage power supply circuit, then phase margin $\Delta\phi$ of the lowered voltage power supply circuit can be increased.

Figure 9:
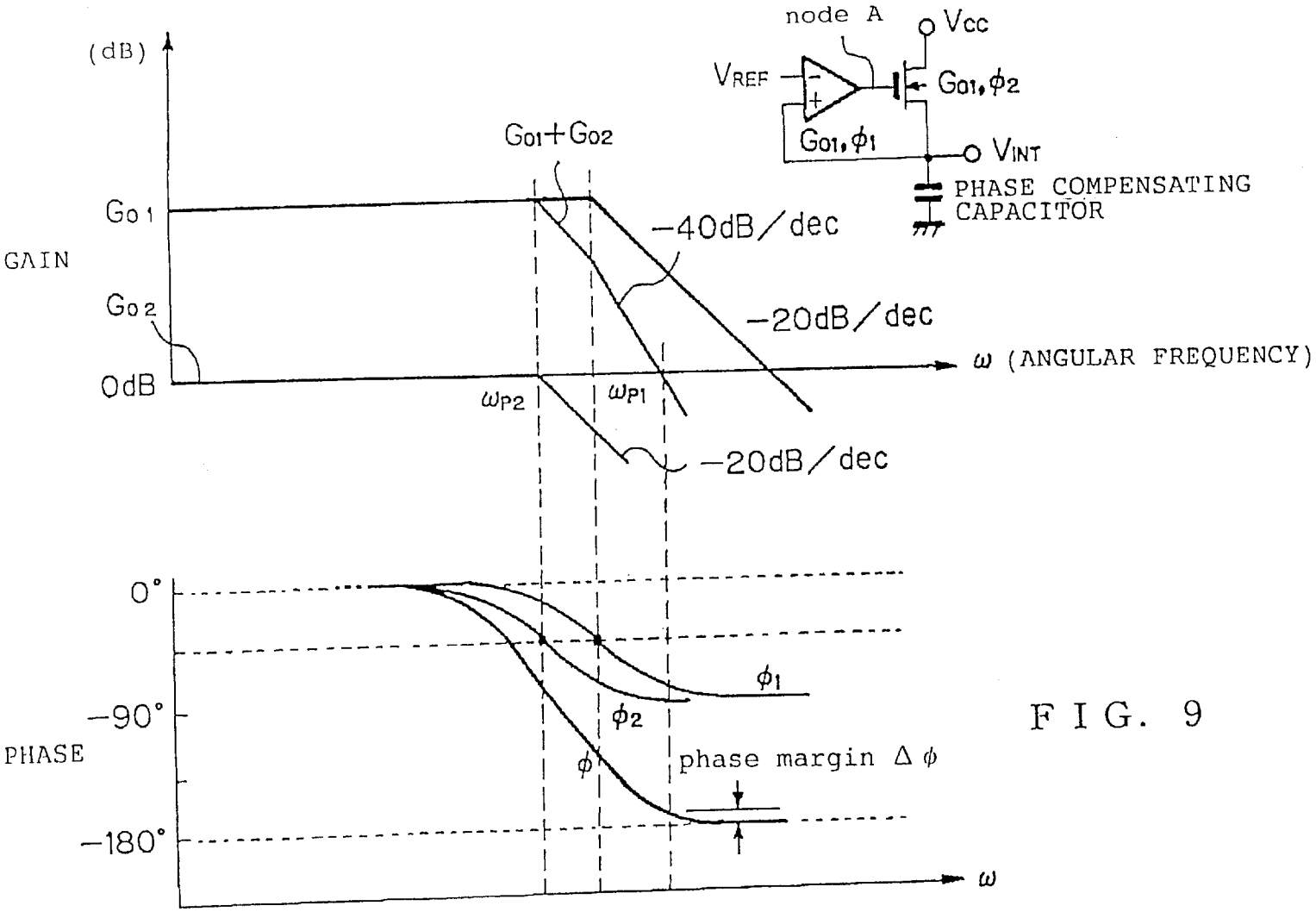
FIG. 9 is a Bode diagram showing a frequency characteristic when the lowered voltage power supply circuit shown in FIG. 7 has a phase margin similar to that in the conventional lowered voltage power supply circuit.

Alternatively, if phase margin $\Delta\phi$ of the lowered voltage power supply circuit of the present embodiment is equal to that of the conventional lowered voltage power supply circuit, then cutoff frequency $\omega_{P2}$ of output transistor 1 can be raised as seen from a Bode diagram of FIG. 9. In other words, since the capacitance of phase compensating capacitor 4 can be reduced, the layout area of devices can be reduced.

Where an N-channel MOSFET is used for output transistor 1 as described above, the maximum value of output voltage $V_{INT}$ is limited to a voltage lower by threshold voltage $V_T$ of output transistor 1 than the voltage at node A of differential amplifier 2. Accordingly, an N-channel MOSFET whose threshold voltage $V_T$ is comparatively low is preferably used for output transistor 1 of the lowered voltage power supply circuit of the present embodiment.

Figure 10A:
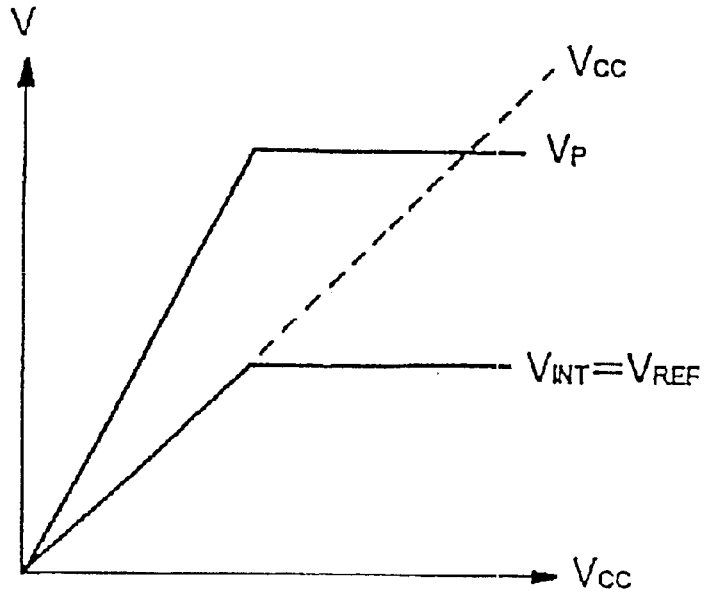
FIG. 10A is a graph illustrating a manner of an output voltage variation with respect to a variation of an external power supply voltage of the lowered voltage power supply circuit shown in FIG. 7.

Further, output voltage $V_{INT}$ preferably rises following external power supply voltage $V_{CC}$ until it is limited to a voltage equal to reference voltage $V_{REF}$ when application of external power supply voltage $V_{CC}$ is started as seen from FIG. 10A. Accordingly, in the lowered voltage power supply circuit of the present embodiment, raised voltage Vp which is a voltage obtained by raising external power supply voltage $V_{CC}$ is supplied to differential amplifier 2.

Figure 11:
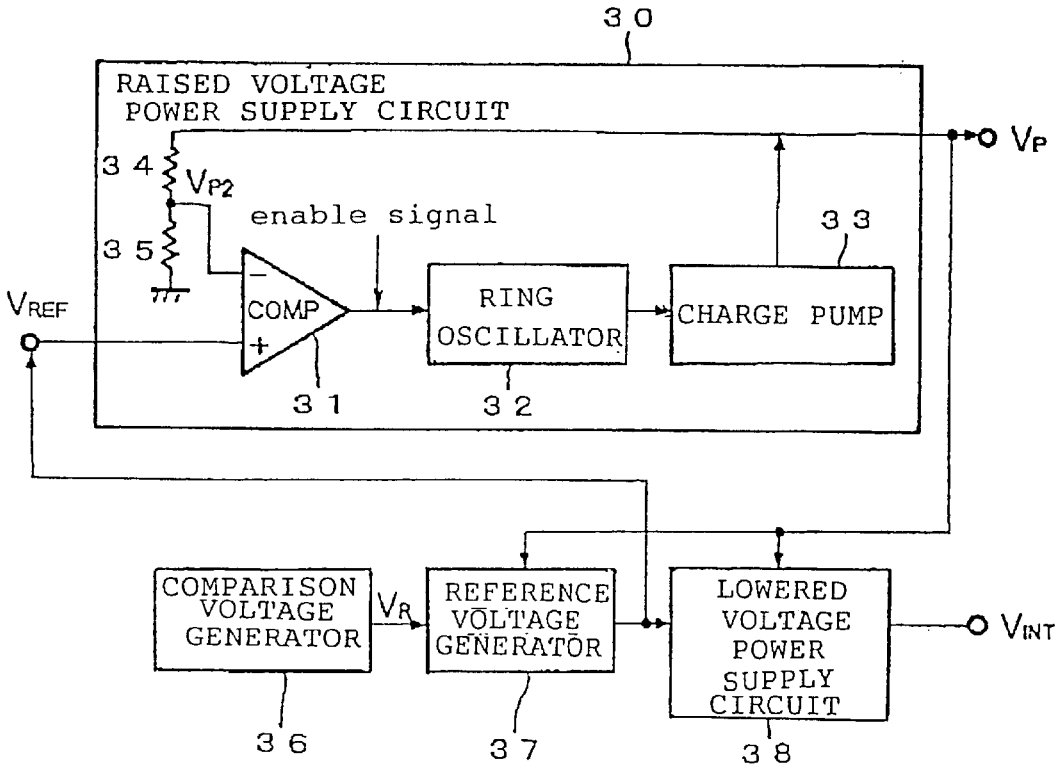
FIG. 11 is a block diagram showing an example of a construction of a raised voltage power supply circuit which generates a raised voltage to be supplied to the lowered voltage power supply circuit shown in FIG. 7.

Although the raised voltage power supply circuit for supplying raised voltage Vp is not particularly limited in construction, it includes a circuit which inputs reference voltage $V_{REF}$ to comparator 31, ring oscillator 32 and charge pump 33 which form a feedback loop as shown in FIG. 11, for example.

Comparator 31 compares voltage Vp2 obtained by dividing raised voltage Vp by resistors 34, 35 with reference voltage $V_{REF}$. IF $Vp2>V_{REF}$, then comparator 31 outputs the H level as an enable signal, but if $Vp2<V_{REF}$, then comparator 31 outputs the L level.

Ring oscillator 32 includes a clock oscillator and supplies clocks to charge pump 33 when the enable signal has the H level, but stops the supply of clocks when the enable signal has the L level.

Charge pump 33 boosts and rectifies the clocks and outputs raised voltage Vp. If raised voltage Vp is higher than a predetermined voltage, then oscillation of ring oscillator 32 is stopped. Consequently, raised voltage Vp lowers gradually. However, if raised voltage Vp becomes lower than the predetermined voltage, then oscillation of ring oscillator 32 is resumed. Consequently, raised voltage Vp rises gradually. In this manner, raised voltage Vp is maintained at the fixed voltage.

Figure 3:
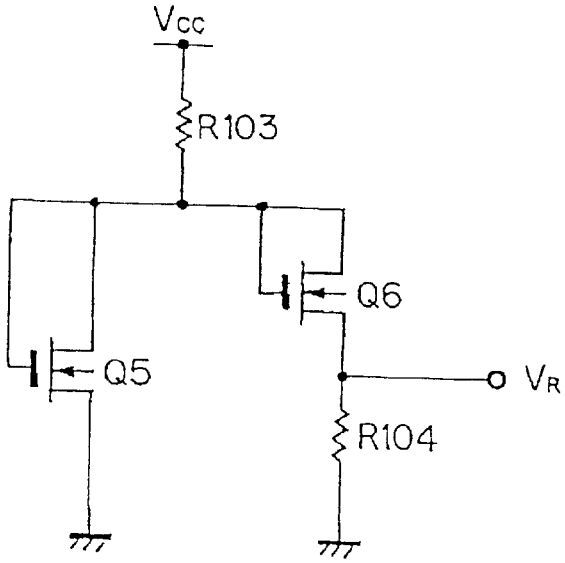
FIG. 3 (PRIOR ART)
FIG. 3 is a circuit diagram showing an example of a construction of a generator for a comparison voltage to be inputted to an inverted input terminal of a differential amplifier shown in FIG. 2.
Figure 4:
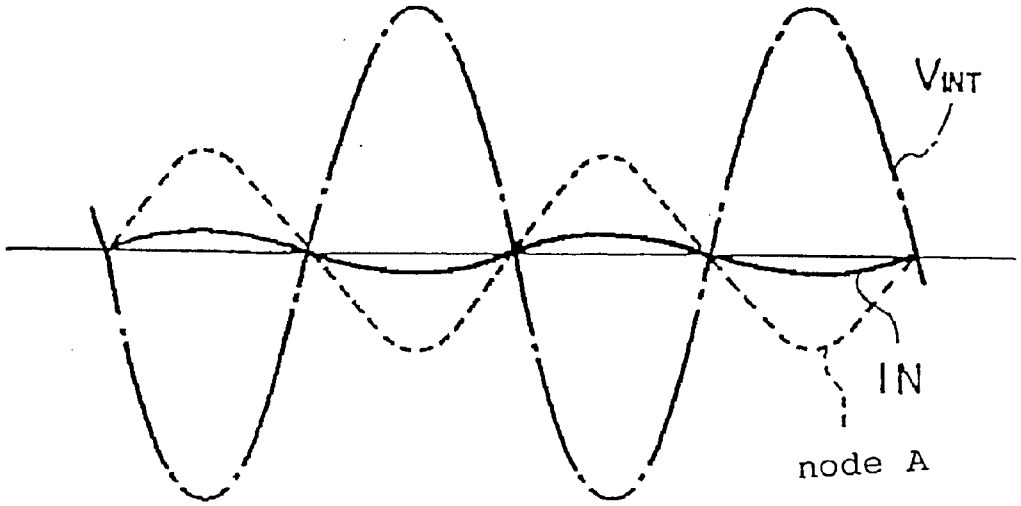
FIG. 4 (PRIOR ART)
FIG. 4 is a waveform diagram showing input and output signal waveforms when the input signal to the lowered voltage power supply circuit shown in FIG. 1 is a low frequency signal.
Figure 5:
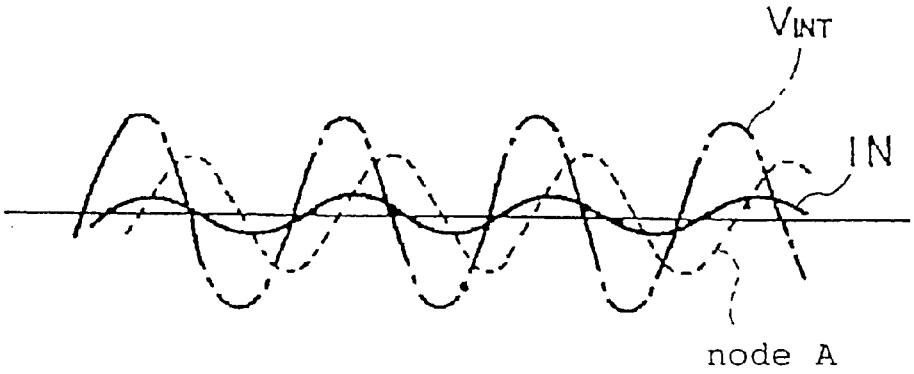
FIG. 5 (PRIOR ART)
FIG. 5 is a waveform diagram showing input and output signal waveforms when the input signal to the lowered voltage power supply circuit shown in FIG. 1 is a high frequency signal.
Figure 6:
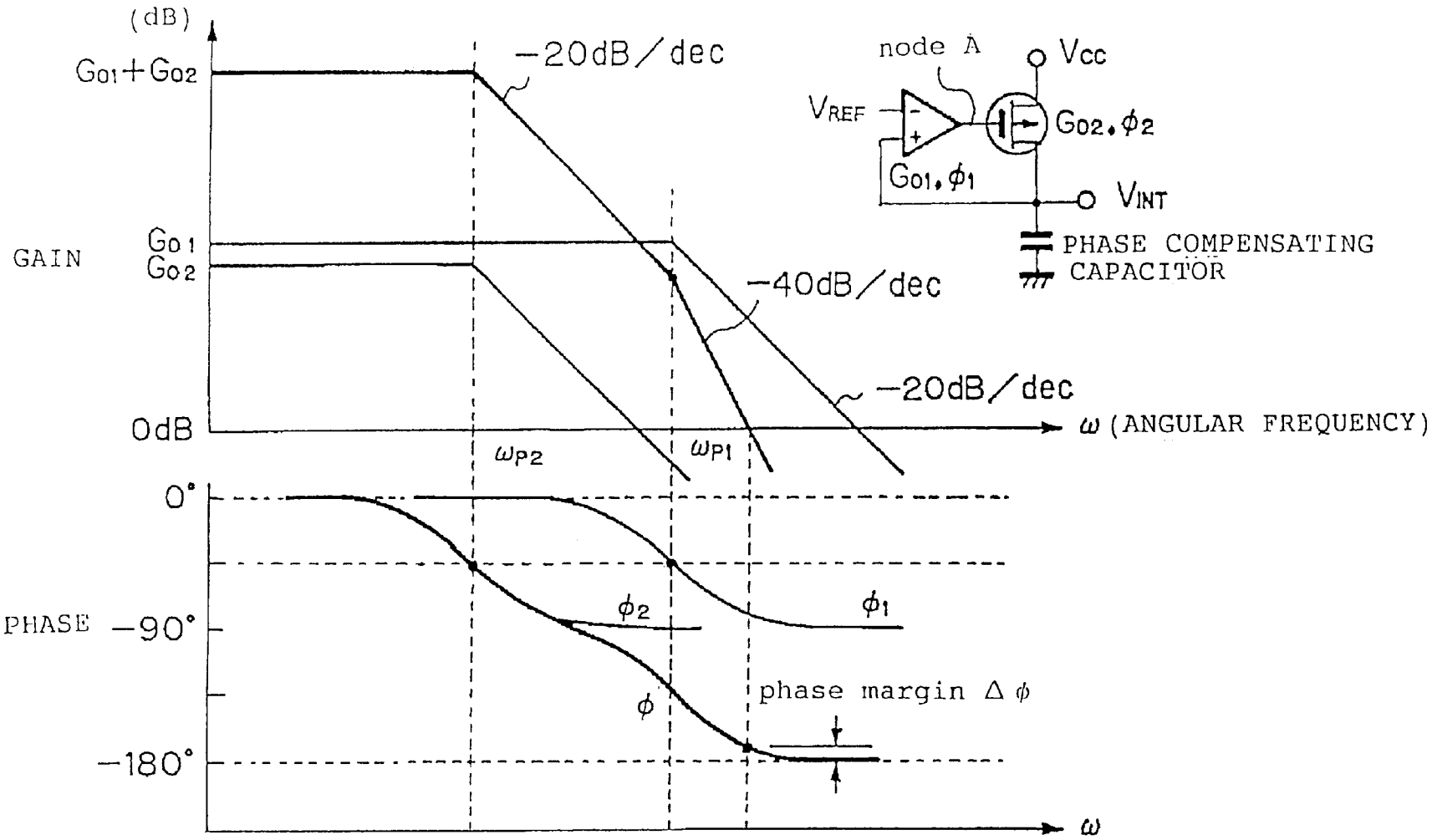
FIG. 6 (PRIOR ART)
FIG. 6 is a Bode diagram showing a frequency characteristic of the lowered voltage power supply circuit shown in FIG. 1.

As seen from FIG. 11, raised voltage Vp is supplied to an internal circuit of the semiconductor integrated circuit and also to reference voltage generator 37 and lowered voltage power supply circuit 38. Comparison voltage generator 36 for outputting the comparison voltage $V_R$ consists of a circuit such as shown in FIG. 3, for example.

(Second Embodiment)

Next, a second embodiment of the internal voltage generator of the present invention will be described taking a reference voltage generator as an example.

Figure 2:
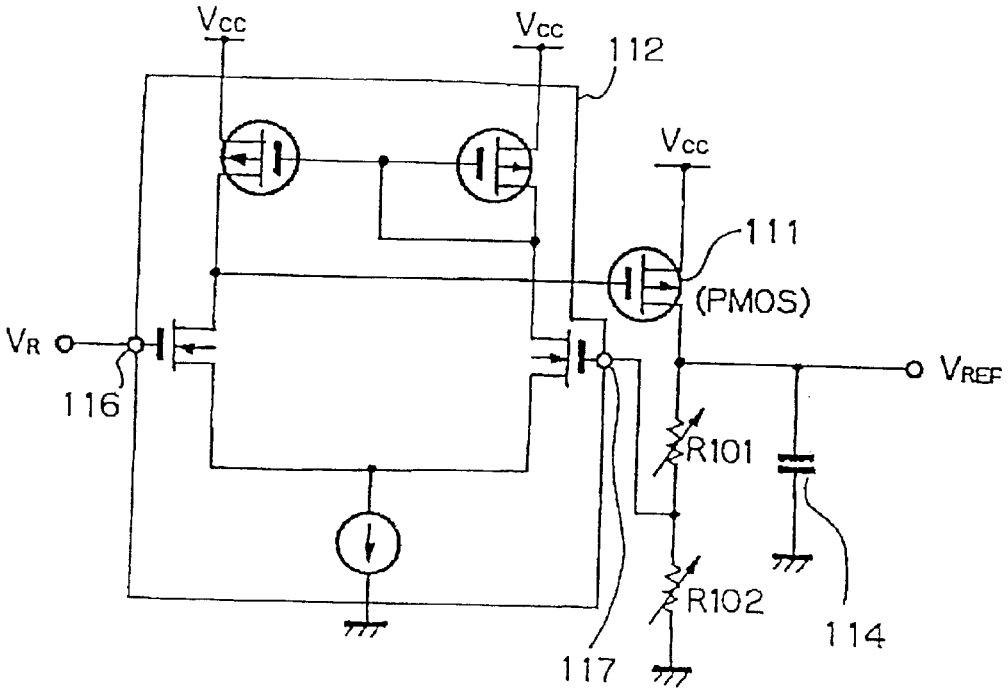
FIG. 2 (PRIOR ART)
FIG. 2 is a circuit diagram showing a construction of a reference voltage generator shown in FIG. 1.
Figure 12:
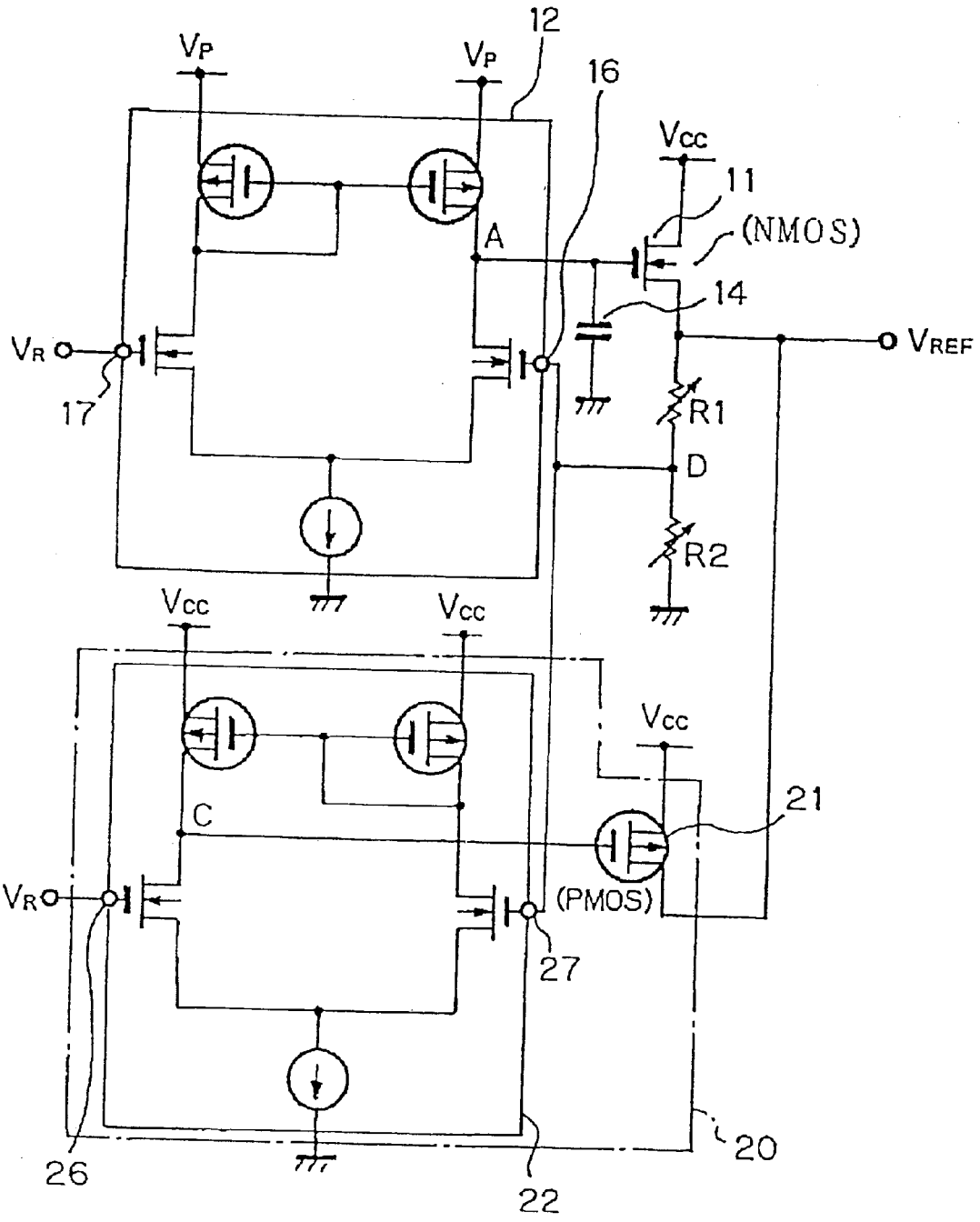
FIG. 12 is a circuit diagram showing an example of a construction of a reference voltage generator according to a second embodiment of the internal voltage generator of the present invention.

Referring to FIG. 12, the reference voltage generator of the second embodiment has a construction modified from the conventional reference voltage generator shown in FIG. 2 wherein output transistor 11 is changed from a P-channel MOSFET to an N-channel MOSFET and raised voltage Vp is supplied to differential amplifier 12. Further, comparison voltage $V_R$ is input to non-inverted input terminal 17 of differential amplifier 12, and reference voltage $V_{REF}$ output from output transistor 11 is fed back to inverted input terminal 16 of differential amplifier 12 after being divided by trimming resistors R1, R2. Further, phase compensating capacitor 14 is interposed between node A which is an output contact of differential amplifier 12 and the ground potential.

Where raised voltage power supply circuit 30 is constructed so as to generate raised voltage Vp from reference voltage $V_{REF}$ as seen in FIG. 11, raised voltage power supply circuit 30 produces raised voltage Vp from reference voltage $V_{REF}$ output from reference voltage generator 37, and reference voltage generator 37 produces reference voltage $V_{REF}$ from raised voltage Vp output from raised voltage power supply circuit 30. Therefore, reference voltage $V_{REF}$ and raised voltage Vp are not output even if external power supply voltage $V_{CC}$ is supplied to the reference voltage generator. Accordingly, reference voltage generator 37 of the present embodiment includes starting up circuit 20 for starting up the reference voltage generator when power supply is made available.

Starting up circuit 20 includes, similarly to the conventional lowered voltage power supply circuit, output transistor 21 formed from a P-channel MOSFET, and differential amplifier 22 for outputting a control voltage to control the gate voltage of output transistor 21. Comparison voltage $V_R$ is input to inverted input terminal 26 of differential amplifier 22, and the voltage obtained by division by trimming resistors R1, R2 is fed back to non-inverted input terminal 27 of differential amplifier 22. External power supply voltage $V_{CC}$ is supplied to output transistor 21 and differential amplifier 22. The output transistor 21 in the form of a p-channel MOSFET operates as a grounded-source circuit.

For the two transistors (N-channel MOSFETs) connected to inverted input terminal 26 and non-inverted input terminal 27 of starting up circuit 20, transistors of different transistor sizes are used so that input offset voltage $V_{OF}$ may be provided to differential amplifier 22. In particular, starting up circuit 20 shown in FIG. 12 operates so that the voltage to be fed back to non-inverted input terminal 27 may be a voltage a little (approximately 0.1 V) lower than comparison voltage $V_R$ applied to inverted input terminal 26. Comparison voltage $V_R$ is supplied from such a circuit as shown in FIG. 3, for example. The construction of the remaining part of the reference voltage generator is similar to that of the conventional reference voltage generator, and therefore, an overlapping description of it is omitted here.

In the reference voltage generator having the construction described above, the voltage obtained by dividing reference voltage $V_{REF}$ by trimming resistors R1, R2 is fed back to inverted input terminal 16 of differential amplifier 12, and reference voltage $V_{REF}$ which depends upon the comparison voltage $V_R$ applied to non-inverted input terminal 17 and the resistance ratio between trimming resistors R1, R2 as given by the following expression (2)

$$V_{REF}=V_R\times(R1+R2)/R2 \quad (2)$$

is output.

Figure 13:
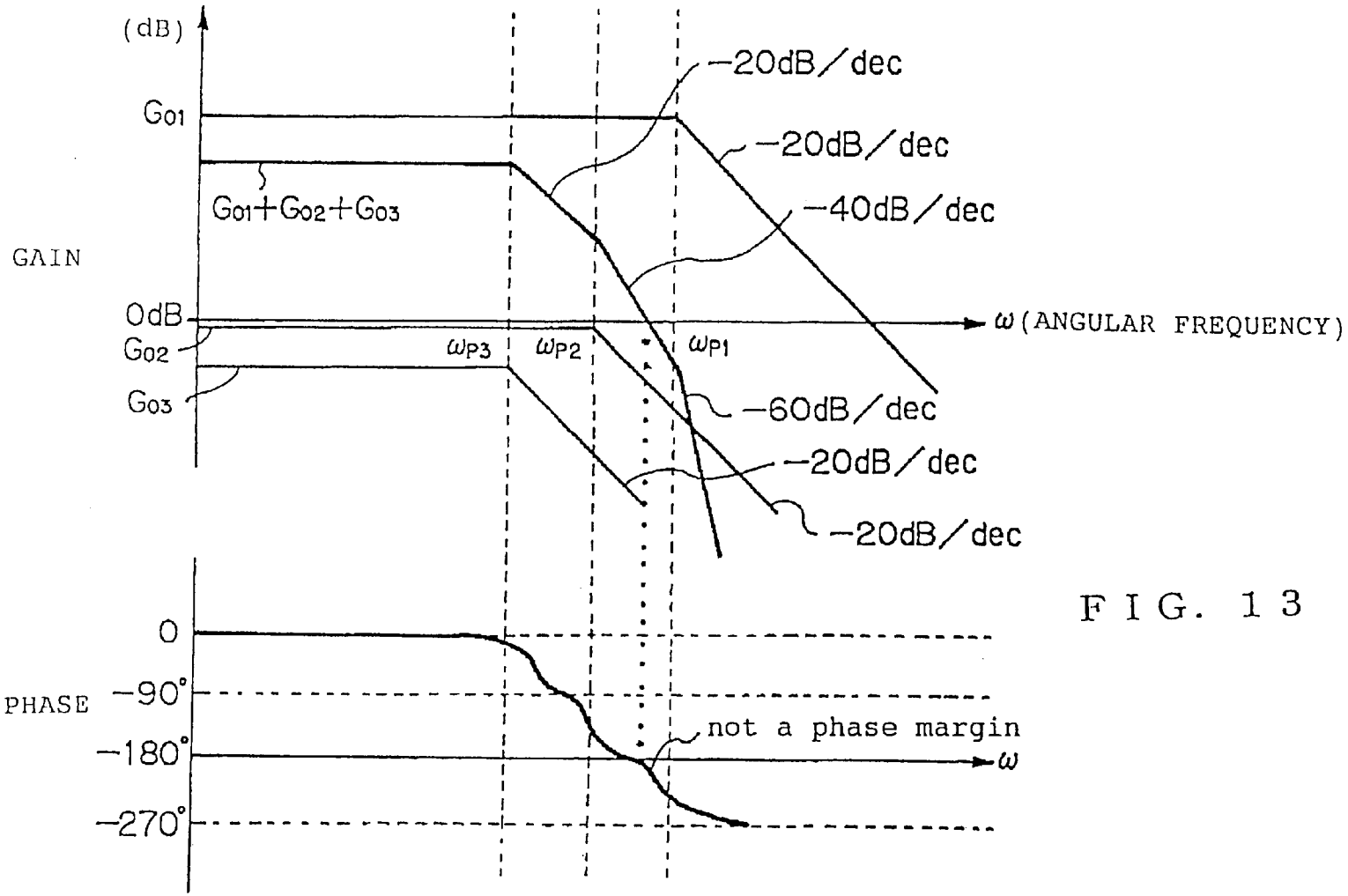
FIG. 13 is a Bode diagram illustrating a frequency characteristic when the position of a phase compensating capacitor and the frequency characteristic of a differential amplifier of the reference voltage generator shown in FIG. 12 are similar to those in the conventional reference voltage generator.

Further, since trimming resistors R1, R2 shown in FIG. 12 have parasitic capacitances, their gain $G_{03}$ has a frequency characteristic having cutoff frequency $\omega_{P3}$ further lower than cutoff frequency $\omega_{P2}$ of output transistor 11. Accordingly, even if output transistor 11 is changed to an N-channel MOSFET to lower gain $G_{02}$, phase margin $\Delta\phi$ of total gain $G_{01}+G_{02}+G_{03}$ of differential amplifier 12 (gain $G_{01}$), output transistor 11 (gain $G_{02}$) and trimming resistors R1, R2 (gain $G_{03}$) is decreased by a delay of the phase arising from the frequency characteristic of trimming resistors R1, R2 as seen from a Bode diagram of FIG. 13, and there is the possibility that the reference voltage generator may oscillate.

Figure 14:
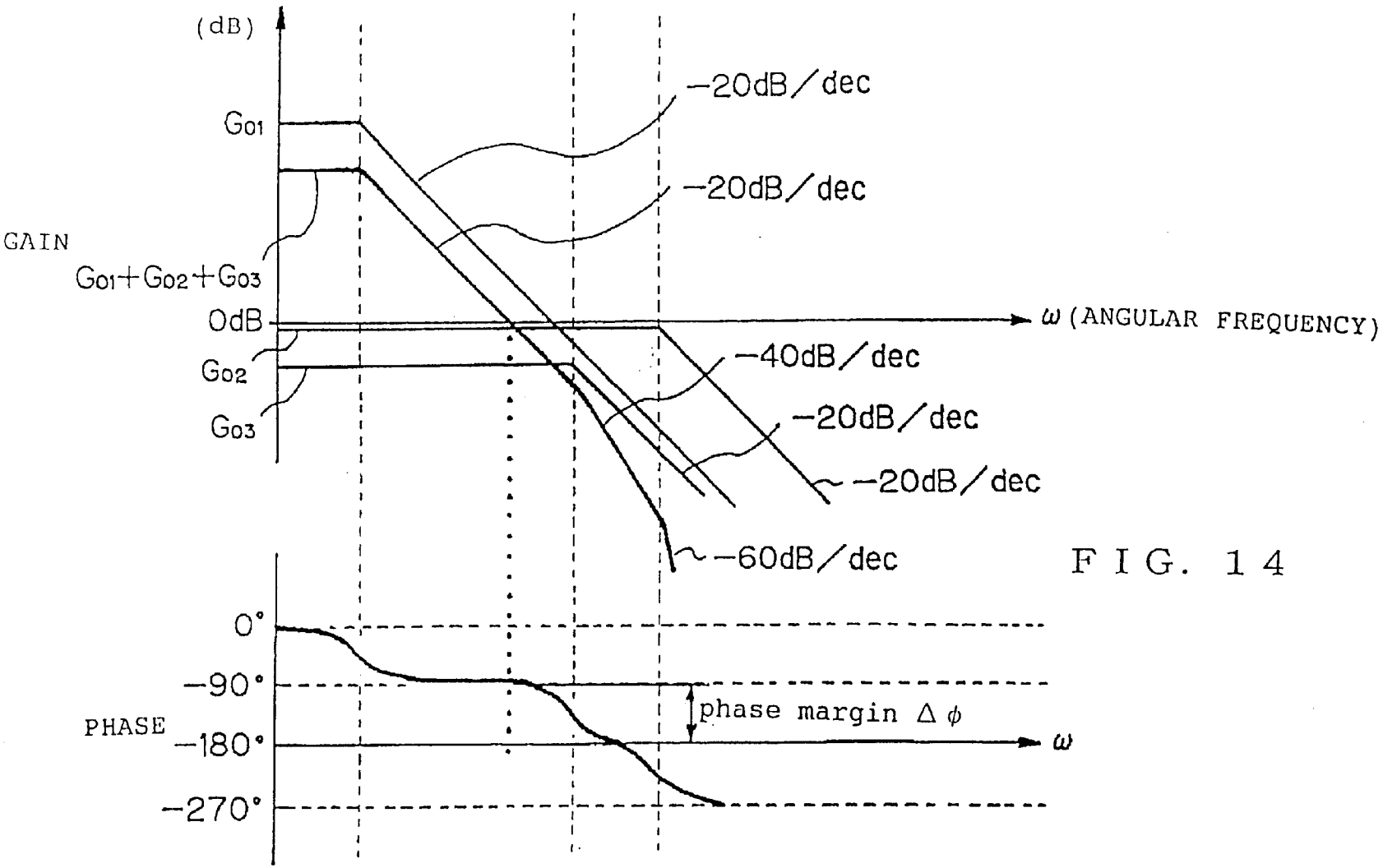
FIG. 14 is a Bode diagram illustrating a manner after the position of the phase compensating capacitor and the frequency characteristic of the differential amplifier of the reference voltage generator shown in FIG. 12 are varied.

Therefore, in the present embodiment, phase compensating capacitor 14 is interposed between the output of differential amplifier 12 (node A) and the ground potential to lower cutoff frequency $\omega_{P1}$ of differential amplifier 12. Further, the current to flow from the current source of differential amplifier 12 is decreased to lower the response speed to lower cutoff frequency $\omega_{P1}$ of differential amplifier 12. This is because differential amplifier 12 need not operate at such a high speed as in the lowered voltage power supply circuit since the reference voltage generator exhibits a comparatively small variation of the load current and has a sufficiently low load resistance when compared with its driving capacity. Total gain $G_{01}+G_{02}+G_{03}$ of differential amplifier 12 (gain $G_{01}$), output transistor 11 (gain $G_{02}$) and trimming resistors R1, R2 (gain $G_{03}$) when the current is decreased is such as indicated by a Bode diagram of FIG. 14 and exhibits an increase in phase margin $\Delta\phi$.

Accordingly, since the capacitance of phase compensating capacitor 14 can be reduced, the layout area for devices can be reduced. Further, since the current to flow from the current source of differential amplifier 12 is decreased, the consumed current of the reference voltage generator can be reduced.

Figure 15:
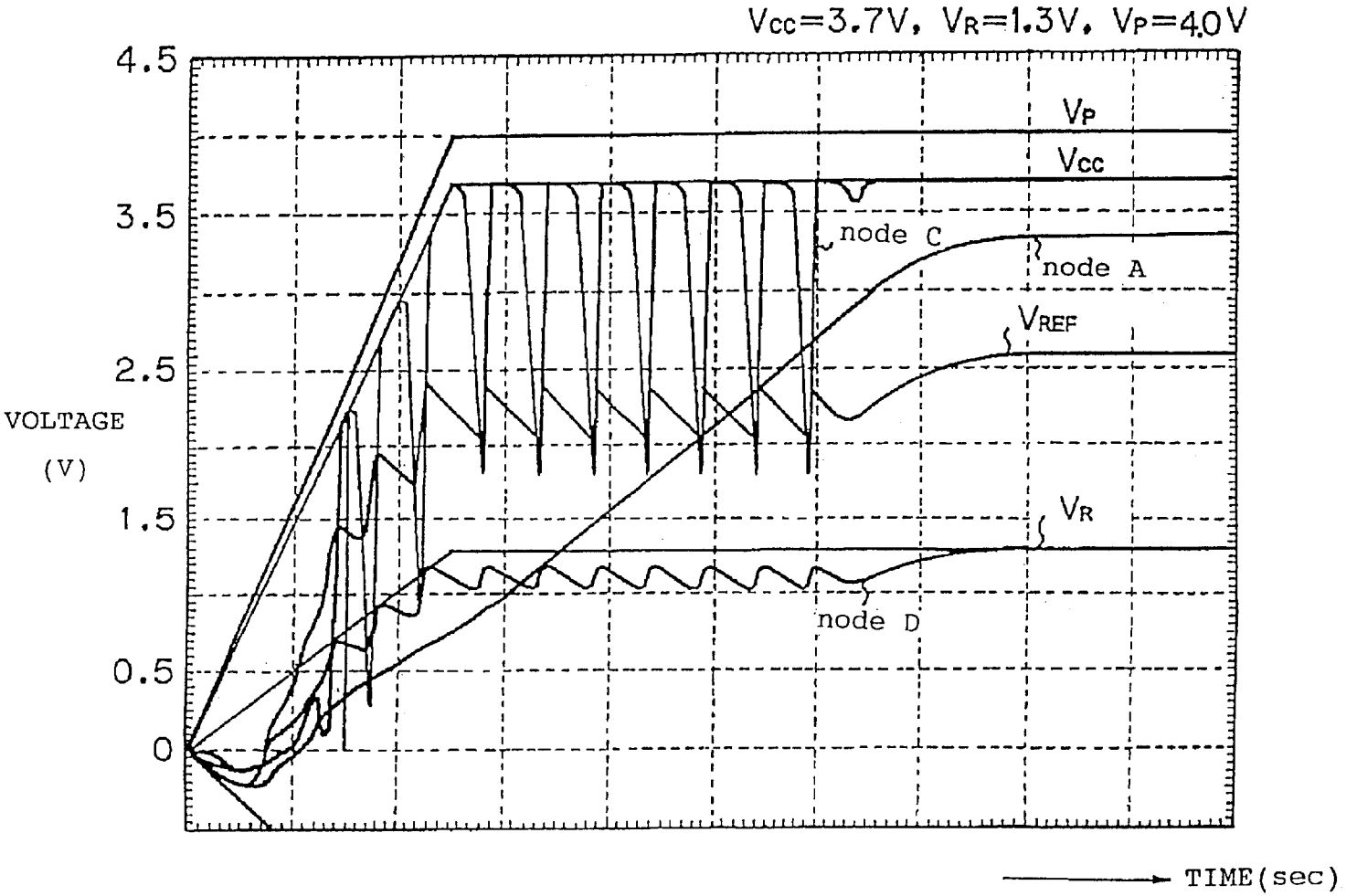
FIG. 15 is a graph showing operation waveforms of several parts when the reference voltage generator shown in FIG. 12 is started up.

On the other hand, starting up circuit 20 raises its output voltage up to $(V_R-V_{OF})\times(R1+R2)/R2$ when the external power supply is on. At this time, since also raised voltage Vp which is produced by utilizing reference voltage $V_{REF}$ rises to a certain level, differential amplifier 12 is rendered operative, and also the output voltage of differential amplifier 12 rises to a predetermined voltage. However, since starting up circuit 20 does not have a phase compensating capacitor, phase margin $\Delta\phi$ thereof is small, and starting up circuit 20 oscillates when it is started up as seen in FIG. 15. FIG. 15 illustrates a result of a simulation conducted with external power supply voltage $V_{CC}$=3.7 V, comparison voltage $V_R$=1.3 V, and raised voltage Vp=4.0 V.

If the output voltage reaches the predetermined voltage, then the voltage to be fed back to non-inverted input terminal 27 (node D) of differential amplifier 22 of starting up circuit 20 becomes equal to comparison voltage $V_R$. Since differential amplifier 22 has input offset voltage $V_{OF}$ as described hereinabove, the voltage at the output contact (node C) of differential amplifier 22 overshoots in the positive direction until it becomes substantially equal to external power supply voltage $V_{CC}$ and output transistor 21 is turned off. Consequently, oscillation of starting up circuit 20 is stopped completely. Where such means for stopping oscillation as just described is provided, even if starting up circuit 20 oscillates upon starting up, there is no problem, and consequently, the current to flow from the current source of differential amplifier 22 of starting up circuit 20 can be decreased.

In the conventional reference voltage generator which employs a P-channel MOSFET for the output transistor, in order to suppress oscillation, high current (approximately 10 $\mu$A, for example) flows from the current source of the differential amplifier of the reference voltage generator to raise the response speed of the differential amplifier.

On the other hand, in the reference voltage generator of the present embodiment, the current to flow from two differential amplifiers 12, 22 can be decreased as described above and can be set to 1 $\mu$A or less, for example. Accordingly, even if components of the circuit increase from those of the conventional reference voltage generator, the total current consumption of the reference voltage generator can be reduced.

Further, since a very high driving capacity is not required for the output transistor of the differential amplifier composing the reference voltage generator, a transistor of a small size can be used for the output transistor, and even if starting up circuit 20 is provided, the layout area does not increase very much.

It is to be noted that, in the present embodiment, differential amplifier 22 is provided with input offset voltage $V_{OF}$ as the means for stopping oscillation of starting up circuit 20. However, as such means, the output of starting up circuit 20 may be switched off after the lapse of a predetermined time after the external power supply is made available, or it may be switched off after a predetermined voltage is reached.

The construction which employs an N-channel MOSFET for the output transistor of a lowered voltage power supply circuit similarly as in the first and second embodiment is disclosed in Japanese Patent Laid-Open No. 30334/1995. The lowered voltage power supply circuit disclosed in Japanese Patent Laid-Open No. 30334/1995, however, indicates that not only a P-channel MOSFET but also an N-channel MOSFET can be used for the output transistor to construct the lowered voltage power supply circuit, but the document is quite silent of a phase compensating capacitor for preventing oscillation. Further, since the power supply voltage to be supplied to the differential amplifier and the power supply voltage to be supplied to the output transistor are common external power supply voltage $V_{CC}$, the value of output voltage $V_{INT}$ is limited as described hereinabove.

Figure 10B:
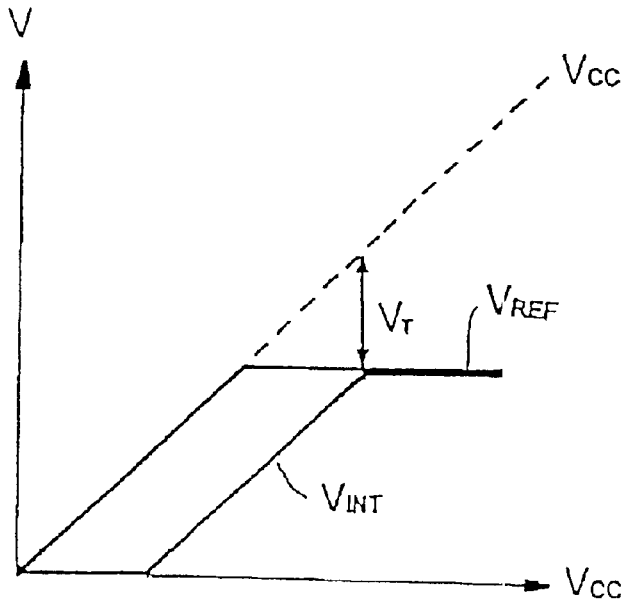
FIG. 10B is a graph illustrating a manner of an output voltage variation with respect to a variation of an external power supply voltage of the conventional lowered voltage power supply circuit.

The manner just described is illustrated in FIG. 10B. As can be seen from FIG. 10B, when external power supply voltage $V_{CC}$ is sufficiently high, output voltage $V_{INT}$ corresponding to reference voltage $V_{REF}$ can be output through the output transistor in the form of an N-channel MOSFET. However, if external power supply voltage $V_{CC}$ becomes lower than $(V_{REF}+V_T)$, then output voltage $V_{INT}$ becomes a voltage lower by threshold voltage $V_T$ of the output transistor than external power supply voltage $V_{CC}$. As a result, the operation power supply voltage range of the semiconductor integrated circuit is narrower than that of the semiconductor integrated circuit of the present invention.

It is to be noted that, while the foregoing description relates to an example of an internal voltage generator which generates a positive voltage, the present invention can be applied also to another internal voltage generator which generates a negative voltage.

Further, while the foregoing description is given of an example wherein the output (reference voltage $V_{REF}$) of the reference voltage generator is supplied to the lowered voltage power supply circuit and output voltage $V_{INT}$ is generated in the lowered voltage power supply circuit, alternatively it is possible to increase the size of the output transistor of the reference voltage generator to raise the driving capacity and supply reference voltage $V_{REF}$ output from the output transistor as output voltage $V_{INT}$.

While a preferred embodiments of the present invention have been described using specific terms, such description is for illustrative purposes only, and it is to be understood that changes and variations may be made without departing from the spirit or scope of the following claims.

What is claimed is:

1. An internal voltage generator comprising:

a $V_{CC}$ power supply;

a raised voltage power supply circuit receiving as an input a reference voltage $V_{REF}$, the raised voltage power supply circuit producing as an output a boosted voltage $V_P$, wherein $V_P>V_{REF}$;

a reference voltage generator producing said reference voltage $V_{REF}$, said reference voltage generator receiving as an input a comparison voltage $V_R$, said reference voltage generator being supplied by both $V_{CC}$ and $V_P$;

an N-channel MOSFET output transistor having a drain connected to said $V_{CC}$ power supply, the N-channel MOSFET providing a lowered voltage $V_{INT}$ at a source, wherein $V_{INT}<V_{CC}$;

a differential amplifier having a non-inverted input terminal connected to said $V_{REF}$, the differential amplifier having an inverted input connected to said $V_{INT}$, the differential amplifier being supplied by said $V_P$, an output of the differential amplifier being connected to a gate of the N-channel MOSFET; and a phase compensating capacitor connected to said $V_{INT}$.

2. The internal voltage generator of claim 1, wherein the reference voltage generator comprises:

first and second reference voltage differential amplifiers, the first reference voltage differential amplifier being supplied by said VP voltage and providing an output connected to a gate of an N-channel reference voltage generator MOSFET, the second reference voltage differential amplifier being supplied by said VCC voltage and providing an output connected to a gate of a P-channel reference voltage generator MOSFET, a drain of the P-channel reference voltage generator MOSFET being connected to a source of the N-channel reference voltage generator MOSFET and providing said $V_{REF}$.

3. The internal voltage generator of claim 2, wherein a non-inverted input of each of the first and second reference voltage differential amplifiers is connected to said $V_R$.

4. The internal voltage generator of claim 3, wherein an inverted input of each of the first and second reference voltage differential amplifiers is connected to a voltage divided version of $V_{REF}$.

5. The internal voltage generator of claim 1, wherein the raised voltage power supply circuit comprises:

a comparator having a positive input connected to said $V_{REF}$;

a ring oscillator having an input connected to an output of the comparator; and a charge pump having an input connected to an output of the ring oscillator, an output of the charge pump providing said $V_P$, said VP also being connected through a voltage divider to a negative input of the comparator.

6. The internal voltage generator of claim 1, further comprising a comparison voltage generator producing said comparison voltage $V_R$.

7. The internal voltage generator of claim 6, wherein the comparison voltage generator comprises first and second comparison voltage generator N-channel MOSFETS, a gate and drain of each said first and second comparison voltage generator N-channel MOSFET being connected through a first comparison voltage generator resistor to said $V_{CC}$, a source of the first comparison voltage generator N-channel MOSFET being connected to ground, a source of the second comparison voltage generator N-channel MOSFET being connected to ground through a second comparison voltage generator resistor, said $V_R$ being provided by said source of said second comparison voltage generator N-channel MOSFET.

8. The internal voltage generator of claim 4, wherein the raised voltage power supply circuit comprises:

a comparator having a positive input connected to said $V_{REF}$;

a ring oscillator having an input connected to an output of the comparator; and a charge pump having an input connected to an output of the ring oscillator, an output of the charge pump providing said $V_P$, said VP also being connected through a voltage divider to a negative input of the comparator.

9. The internal voltage generator of claim 8, further comprising a comparison voltage generator producing said comparison voltage $V_R$.

10. The internal voltage generator of claim 9, wherein the comparison voltage generator comprises first and second comparison voltage generator N-channel MOSFETS, a gate and drain of each said first and second comparison voltage generator N-channel MOSFET being connected through a first comparison voltage generator resistor to said $V_{CC}$, a source of the first comparison voltage generator N-channel MOSFET being connected to ground, a source of the second comparison voltage generator N-channel MOSFET being connected to ground through a second comparison voltage generator resistor, said $V_R$ being provided by said source of said second comparison voltage generator N-channel MOSFET.

11. The internal voltage generator according to claim 1, wherein said output transistor has a low threshold voltage.

12. The internal voltage generator according to claim 1, wherein said phase compensating capacitor is interposed between said source of said output transistor and a ground potential.

13. The internal voltage generator according to claim 1, wherein said differential amplifier has a cutoff frequency set to such a low level by decreasing the current to flow therethrough that said feedback loop does not oscillate.

* * * * *